US007902478B2

(12) United States Patent
Kriegel et al.

(10) Patent No.: US 7,902,478 B2
(45) Date of Patent: Mar. 8, 2011

(54) SWITCHING CHAMBER FOR A GAS-INSULATED HIGH-VOLTAGE SWITCH

(75) Inventors: Martin Kriegel, Unterehrendingen (CH); Markus Vestner, Büsingen (CH); Olaf Hunger, Schaffhausen (CH)

(73) Assignee: ABB Technology AG, Zurich (CH)

( * ) Notice: Subject to any disclaimer, the term of this patent is extended or adjusted under 35 U.S.C. 154(b) by 401 days.

(21) Appl. No.: 12/182,838

(22) Filed: Jul. 30, 2008

(65) Prior Publication Data

US 2009/0008367 A1 Jan. 8, 2009

Related U.S. Application Data

(63) Continuation of application No. PCT/CH2007/000013, filed on Jan. 12, 2007.

(30) Foreign Application Priority Data

Jan. 31, 2006 (EP) ..... 06405045

(51) Int. Cl.
*H01H 33/02* (2006.01)

(52) U.S. Cl. ..... 218/43; 218/78; 218/154

(58) Field of Classification Search ..... 218/7, 13, 218/14, 43, 45, 51–57, 59–64, 67–73, 78, 218/84, 154
See application file for complete search history.

(56) References Cited

U.S. PATENT DOCUMENTS

| | | | | |
|---|---|---|---|---|
| 6,015,960 | A * | 1/2000 | Girodet et al. | 218/43 |
| 6,040,970 | A | 3/2000 | Lehmann et al. | |
| 6,483,064 | B2 * | 11/2002 | Dufournet et al. | 218/53 |
| 2008/0047813 | A1 * | 2/2008 | Vestner et al. | 200/48 V |

FOREIGN PATENT DOCUMENTS

| | | | |
|---|---|---|---|
| CH | 655 604 | A5 | 4/1986 |
| DE | 1 704 493 | U | 8/1955 |
| DE | 1 130 038 | B | 5/1962 |
| DE | 296 07 660 | U1 | 6/1996 |
| EP | 0 806 049 | B1 | 3/2000 |

OTHER PUBLICATIONS

PCT/ISA/210
PCT/ISA/237.
EPA Form 1507.

* cited by examiner

*Primary Examiner* — Renee Luebke
*Assistant Examiner* — Marina Fishman
(74) *Attorney, Agent, or Firm* — Buchanan Ingersoll & Rooney PC

(57) ABSTRACT

The switching chamber is intended for a gas-insulated high-voltage switch. It contains a housing filled with insulating gas and a contact arrangement held in the housing. The contact arrangement has, in a coaxial arrangement, the following components: two switching pieces, which are capable of being moved relative to one another along an axis, with in each case one arcing contact and in each case one tubular conductor containing a rated current contact, an insulating nozzle, and a compression apparatus with a fixed piston and a cylinder. A moveable tubular conductor of the two tubular conductors forms the wall of the cylinder, is electrically conductively and rigidly connected to one of the two arcing contacts via a base of the cylinder and bears the insulating nozzle.

16 Claims, 5 Drawing Sheets

SWITCHING CHAMBER FOR A GAS-INSULATED HIGH-VOLTAGE SWITCH

RELATED APPLICATIONS

This application claims priority under 35 U.S.C. §119 to European Application 06405045.3 filed in Europe on Jan. 31, 2006, and as a continuation application under 35 U.S.C. §120 to PCT/CH2007/000013 filed as an International Application on Jan. 12, 2007 designating the U.S., the entire contents of which are hereby incorporated by reference in their entireties.

TECHNICAL FIELD

The present disclosure relates to a switching chamber for a gas-insulated high-voltage. The disclosure also relates to a switch with such a switching chamber.

BACKGROUND INFORMATION

A switching chamber of the abovementioned type is generally used in gas-insulated circuit breakers in the voltage range of above 70 kV and for disconnection currents of above 10 kA and is filled with an insulating gas which has arc-quenching properties, for example on the basis of sulfur hexafluoride and/or nitrogen and/or carbon dioxide with a pressure of generally up to a few bar. Since such circuit breakers are designed for switching high and low short-circuit currents, in the event of a switching operation a considerable amount of hot arcing gas is released as a result of the switching arc which is formed, possibly in the form of an explosion, and this arcing gas puts a severe mechanical and electrical strain on the switching chamber. All of the components arranged in the switching chamber, such as switching pieces, an insulating nozzle and a compression apparatus actuated by switching pieces, are therefore connected to one another and supported in the switching chamber housing in such a way that they withstand the high forces occurring during the formation of the arc even once high short-circuit currents have been disconnected a plurality of times.

A switching chamber of the type mentioned at the outset with a housing filled with insulating gas and a contact arrangement held in the housing is described in EP 0 806 049 B1. With the switching chamber described, two rated current contacts of the contact arrangement are each formed by the cold deformation of two metal pipes, and the piston of a piston/cylinder compression apparatus actuated by the switch drive and a fixed bearing element of a sliding guide of a moveable arcing contact of the contact arrangement are held in a cold-deformable metal pipe by means of plastic deformation, for example curling, of the metal pipe. This switching chamber can therefore be manufactured without a screw connection with comparatively little complexity.

SUMMARY

Exemplary embodiments disclosed herein can provide a switching chamber of the type mentioned at the outset which can be manufactured using simple means and with a high level of fitting accuracy.

A switching chamber for a gas-insulated high-voltage switch is disclosed with a housing filled with insulating gas and a contact arrangement held in the housing, containing, in a coaxial arrangement, two switching pieces, which are capable of being displaced relative to one another along an axis, with in each case one arcing contact and in each case one tubular conductor, which is electrically conductively connected to the arcing contact and into which a rated current contact, which surrounds the arcing contact, is formed, an insulating nozzle, which surrounds the two arcing contacts, and a compression apparatus with a fixed piston and a cylinder, in which a moveable first of the two tubular conductors forms the wall of the cylinder, is electrically conductively and rigidly connected to a first of the two arcing contacts via a base of the cylinder and bears the insulating nozzle, wherein a screw connection is arranged in the peripheral region of the insulating nozzle, of the cylinder base, of a first mounting flange for fixing the piston on the switching chamber housing or of a second mounting flange for fixing a deflection gear mechanism, which is connected to the second arcing contact, which screw connection has a radially displaceable locking element, which fixes the insulating nozzle, the cylinder base, the first or the second mounting flange by spreading into and being clamped in one of the two tubular conductors or in the switching chamber housing.

In another aspect, a contact arrangement is disclosed. The contact arrangement is held in a housing of a switching chamber for a gas-insulated high-voltage switch, comprising, in a coaxial arrangement: two switching pieces, which are capable of being displaced relative to one another along an axis, with in each case one arcing contact and in each case one tubular conductor, which is electrically conductively connected to the arcing contact and into which a rated current contact, which surrounds the arcing contact, is formed; an insulating nozzle, which surrounds the two arcing contacts; and a compression apparatus with a fixed piston and a cylinder, in which a moveable first of the two tubular conductors forms the wall of the cylinder, is electrically conductively and rigidly connected to a first of the two arcing contacts via a base of the cylinder and bears the insulating nozzle. A screw connection is arranged in the peripheral region of the insulating nozzle, of the cylinder base, of a first mounting flange for fixing the piston on the switching chamber housing or of a second mounting flange for fixing a deflection gear mechanism, which is connected to the second arcing contact, which screw connection has a radially displaceable locking element, which fixes the insulating nozzle, the cylinder base, the first or the second mounting flange by spreading into and being clamped in one of the two tubular conductors or in the switching chamber housing.

BRIEF DESCRIPTION OF THE DRAWINGS

Exemplary embodiments of the disclosure will be explained in more detail below with reference to drawings, in which.

DETAILED DESCRIPTION

Figure 1:
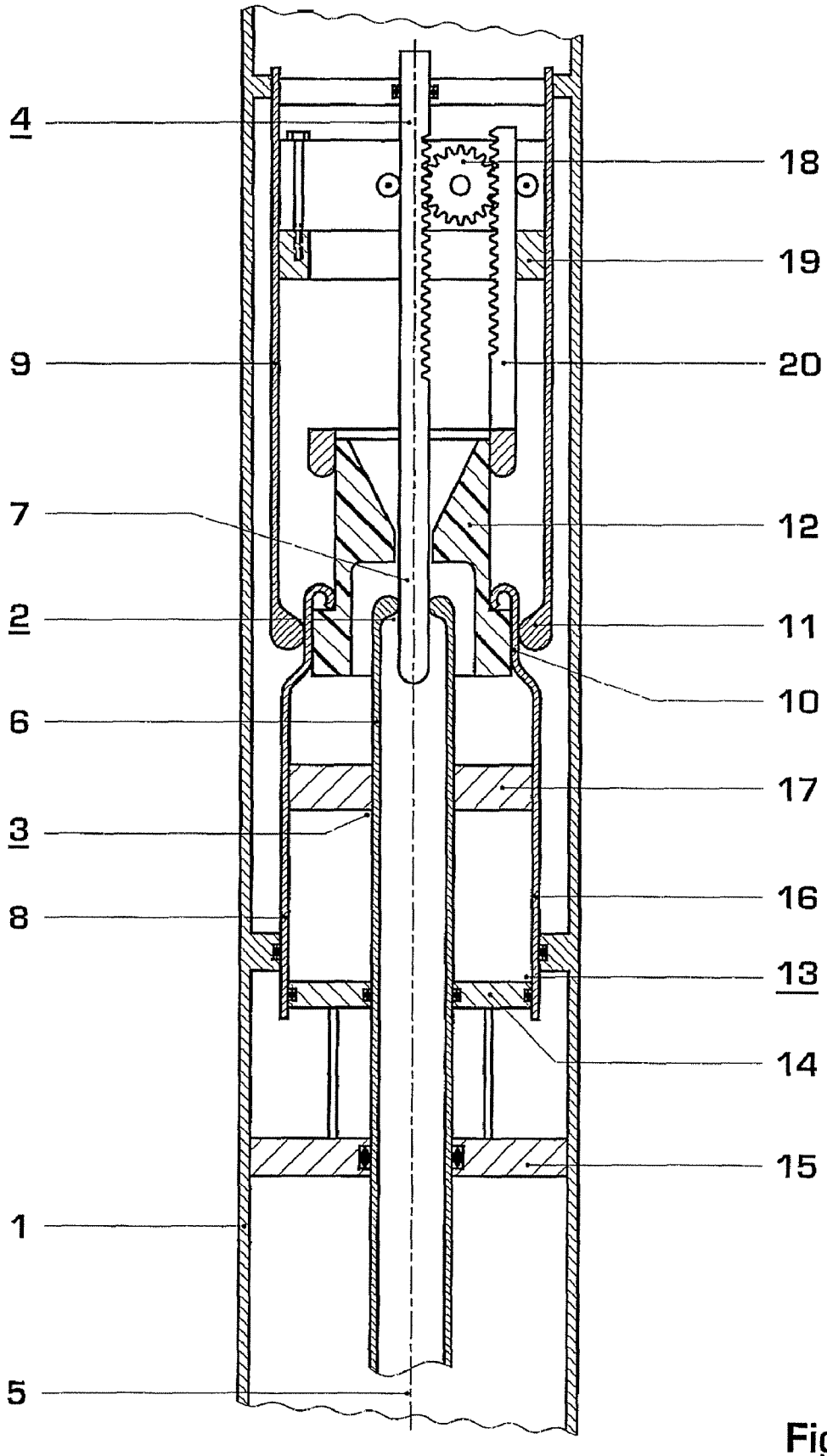
FIG. 1 shows a plan view of a section, guided along an axis, through a switching chamber in accordance with the disclosure.

With the switching chamber according to the disclosure, a screw connection is arranged in the peripheral region of a component, which screw connection has a radially displaceable locking element, which fixes the component by spreading into and being clamped in one of two tubular conductors or in the switching chamber housing. Thus, a detachable connection between one of the abovementioned components and one of the two tubular conductors or the switching chamber housing is formed. The thus connected component can therefore be replaced easily, for example during maintenance work. In addition, the connection can be matched to the tubular conductor or to the switching chamber housing during fitting, with the result that unavoidable fitting inaccuracies are compensated for and very precise positioning of the component in the switching chamber is made possible during manufacture. At the same time, a form-fitting and force-fitting connection is used to ensure a defined mechanical and electrical connection which in addition is largely independent of the material of the component. The mounting complexity is in each case low since the component can be aligned precisely during manufacture and then can be fixed easily in the tubular conductor or in the switching chamber housing with the aid of the screw connection. Such components are an insulating nozzle, a cylinder base of a compression apparatus, a first mounting flange for fixing a piston of the compression apparatus on the housing of the switching chamber or a second mounting flange for fixing a deflection gear mechanism which is connected to an arcing contact of a contact arrangement.

If screw connections of the abovementioned type with a locking element having a spreading and clamping effect are used for fixing two, three or four of the abovementioned components in the tubular conductors or in the switching chamber housing, the manufacturing costs are considerably reduced since in this case the number of connecting elements required can be kept low.

If a projection or a depression is formed into the switching chamber housing or into one of the two tubular conductors, the component can be fixed in the switching chamber housing or in one of the two tubular conductors by means of a form-fitting connection.

In a first exemplary embodiment which is primarily advantageous for metallic components such as the cylinder base or one of the two mounting flanges, a screw of the screw connection is guided in an axially aligned nut thread, which is arranged in the insulating nozzle, the cylinder base, the first or the second mounting flange, and this screw has a free end in the form of a cone, which free end is supported on oppositely inclined faces of two wedges. These two wedges are either formed into the two ends of a locking element in the form of an open circular ring or a first one of these two wedges is formed into a first circular ring segment and the second is formed into a second circular ring segment, in each case of a locking element in the form of a segmented circular ring.

In a second exemplary embodiment which is also easy to realize in components consisting of insulating material, such as the insulating nozzle, a screw of the screw connection is plugged through an axially aligned through-opening of the insulating nozzle, of the cylinder base, of the first or of the second mounting flange and engages in a nut thread, which is formed into an axially guided compression ring or into a nut arranged on the compression ring. The locking element is arranged between the insulating nozzle, the cylinder base, the first or the second mounting flange and the compression ring and is guided radially outwards by means of the wedge effect. The wedge effect is produced in a simple manner by a wedge formed into the locking element, which wedge is guided on an outwardly inclined bearing face of the insulating nozzle, of the cylinder base, of the first or of the second mounting flange or of the compression ring. In order to achieve particularly uniform loading, this wedge can have two oppositely and inwardly inclined wedge faces, of which the first wedge face is guided on an outwardly inclined bearing face of the insulating nozzle, of the cylinder base, of the first or of the second mounting flange and the second is guided on an outwardly inclined face of the compression ring.

The same reference symbols relate to functionally identical parts in all of the figures. The switching chamber illustrated in FIG. 1 is part of a high-voltage circuit breaker and can be used, for example, in a high-voltage system with a rated voltage of 250 kV. This chamber contains a housing 1, which is filled with a compressed insulating gas, for example based on sulfur hexafluoride or a gas mixture containing sulfur hexafluoride and is largely tubular, and a contact arrangement 2, which is accommodated by the switching chamber housing 1 and is largely axially symmetrical. The contact arrangement 2 has two switching pieces 3, 4, which are arranged moveably relative to one another along the axis of symmetry 5. The switching pieces 3 and 4 contain, in a coaxial arrangement, in each case one arcing contact 6 or 7 and one tubular conductor 8 or 9, which is electrically conductively connected to the arcing contact 6 or 7. A rated current contact 10 is formed into the tubular conductor 8, and a rated current contact 11 is formed into the tubular conductor 9. The two arcing contacts 6, 7 are surrounded coaxially by an insulating nozzle 12. The reference symbol 13 denotes a compression apparatus. A piston 14 of the compression apparatus 13 is held rigidly on a mounting flange 15, which is fixed for its part rigidly on the switching chamber housing 1. A cylinder 16 of the compression apparatus 11 has a wall, which is formed by a section of the moveable tubular conductor 8, and a base 17, which connects the tubular conductor 8 electrically conductively and rigidly to the arcing contact 6. The arcing contact 7 is integrated in an axially displaceable rod of a deflection gear mechanism 18, which is held on a mounting flange 19 fixed in the tubular conductor 9 and contains a drive rod 20, which is fixed at the exhaust end of the nozzle 12.

When the contact arrangement 2 opens or closes, the arcing contact 6 is displaced along the axis 5 with the aid of a drive (not illustrated). In the same direction, the tubular conductor 8, the insulating nozzle 12 and the rod 20 are also displaced, whereas the arcing contact 7 is displaced in the reverse direction via the deflection gear mechanism 18. The drive force which occurs in this process and is active predominantly axially is transmitted directly to the deflection gear mechanism 18 via the cylinder base 17, the tubular conductor 8 and the insulating nozzle 12. Radially acting guide forces are absorbed by the mounting flange 15, the piston 14, which is held on the mounting flange 15, and the deflection gear mechanism 18, which is held on the mounting flange 19. These components therefore need to be fixed well for safe operation of the switching chamber. In order at the same time to facilitate manufacture and maintenance of the switching chamber, a screw connection (shown in FIGS. 2 to 9) is arranged in the peripheral region of at least one of these force-transmitting and/or force-absorbing components, which screw connection has a radially displaceable locking element, which fixes these components, i.e. in particular the insulating nozzle 12, the cylinder base 17, the mounting flange 15 or the mounting flange 19, by spreading into and being clamped on one of the two tubular conductors 8, 9 or on the switching chamber housing 1.

Figure 6:
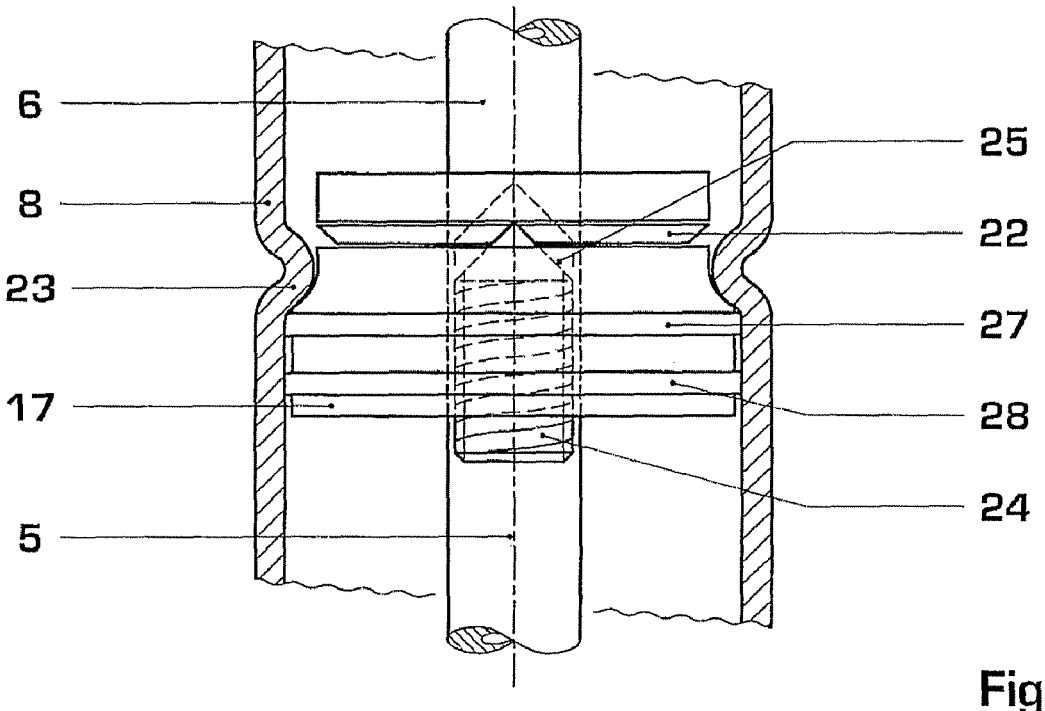
FIG. 6 shows a view, guided at right angles with respect to the axis, of part of a second exemplary embodiment of the switching chamber shown in FIG. 1, which part contains a cylinder base, before the cylinder base is fixed on a tubular conductor.
Figure 7:
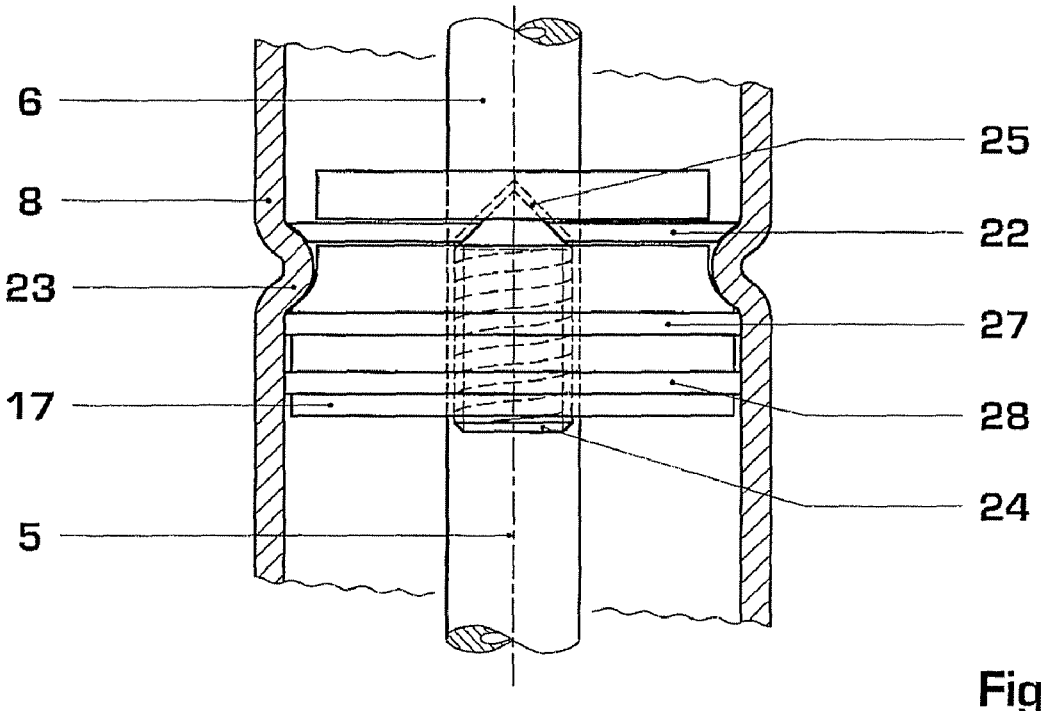
FIG. 7 shows a plan view in the arrow direction of a section guided along V-V through the switching chamber shown in FIG. 6.
Figure 8:
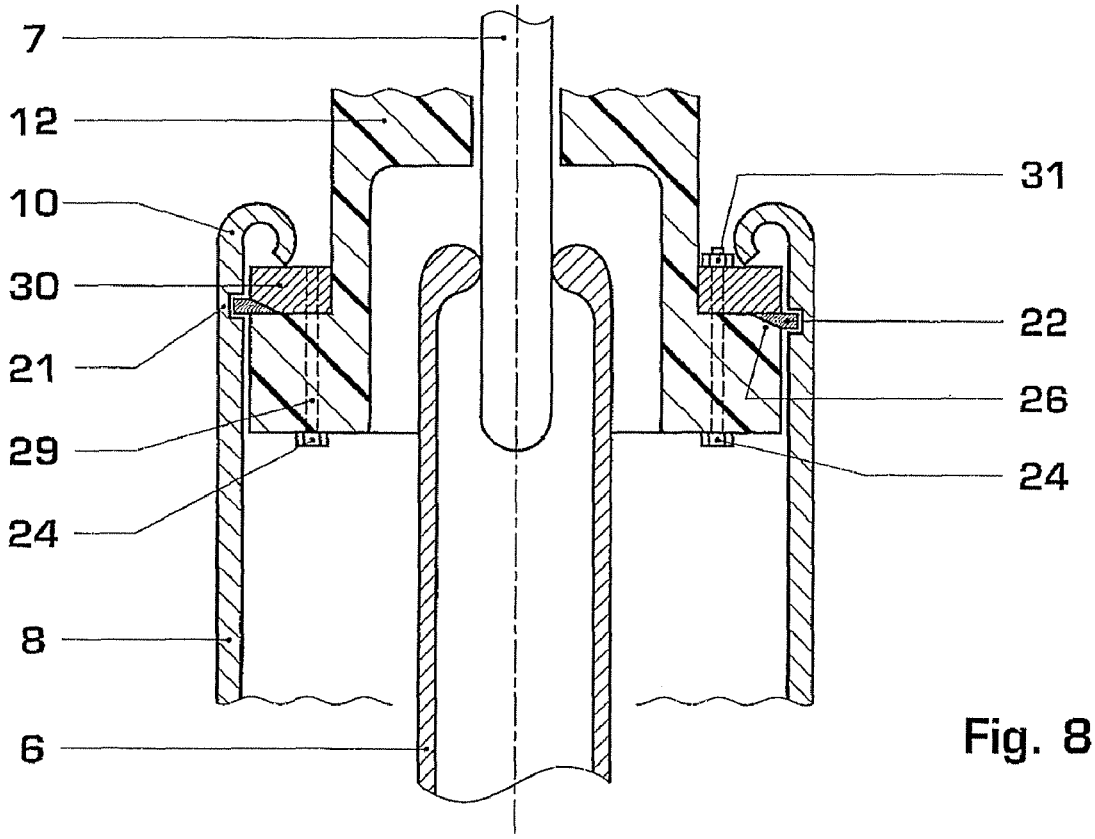
FIG. 8 shows a view, guided at right angles with respect to the axis, of part of a third and fourth exemplary embodiment of the switching chamber shown in FIG. 1, which part contains an insulating nozzle, in which view the insulating nozzle is fixed on a tubular conductor.
Figure 9:
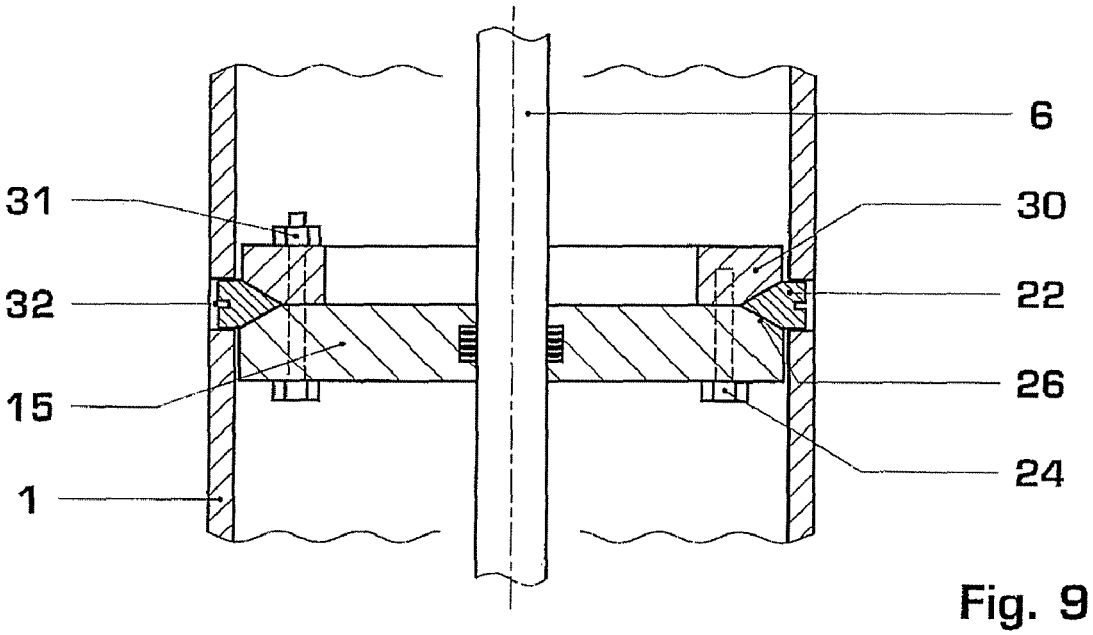
FIG. 9 shows a view, guided at right angles with respect to the axis, of part of a fifth exemplary embodiment of the switching chamber shown in FIG. 1, which part contains a mounting flange, in which view the mounting flange is fixed on the switching chamber housing.

In the two exemplary embodiments shown in FIGS. 2 to 7, in each case the cylinder base 17 is provided as the force-transmitting part, in the exemplary embodiment shown in FIG. 8, the insulating nozzle 12 is provided as the force-transmitting part, and in the exemplary embodiment shown in FIG. 9, the mounting flange 15 is provided as the force-transmitting part. In the exemplary embodiment shown in FIGS. 2 to 5, a depression 21 is formed into the tubular conductor 8, and a locking element 22 is spread into said depression 21 during manufacture of the switching chamber. This locking element 22 is guided radially in an annular cutout of the cylinder base 17, which cutout opens out into the outer casing of the cylinder base 17. On the other hand, in the exemplary embodiment shown in FIGS. 6 and 7, a generally annular projection 23 is formed into the tubular conductor 8, and the locking element 22, which is guided in the slot, engages behind said annular projection 23 in the course of manufacture.

Figure 2:
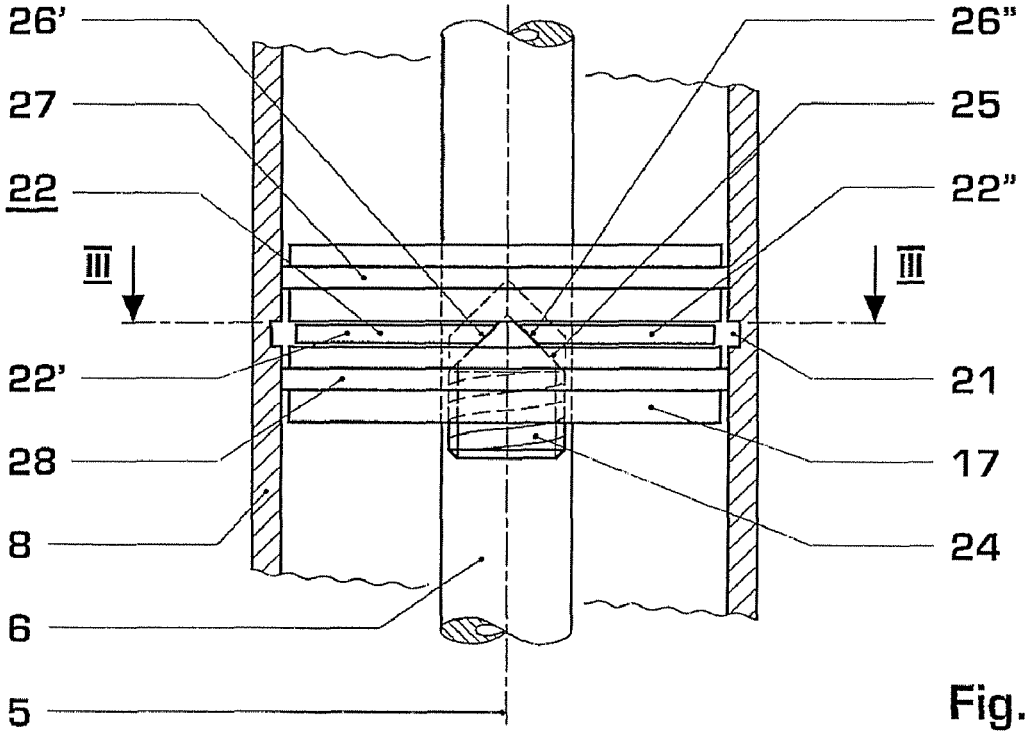
FIG. 2 shows a view, guided at right angles with respect to the axis, of part of a first exemplary embodiment of the switching chamber shown in FIG. 1, which part contains a cylinder base, before the cylinder base is fixed on a tubular conductor.
Figure 3:
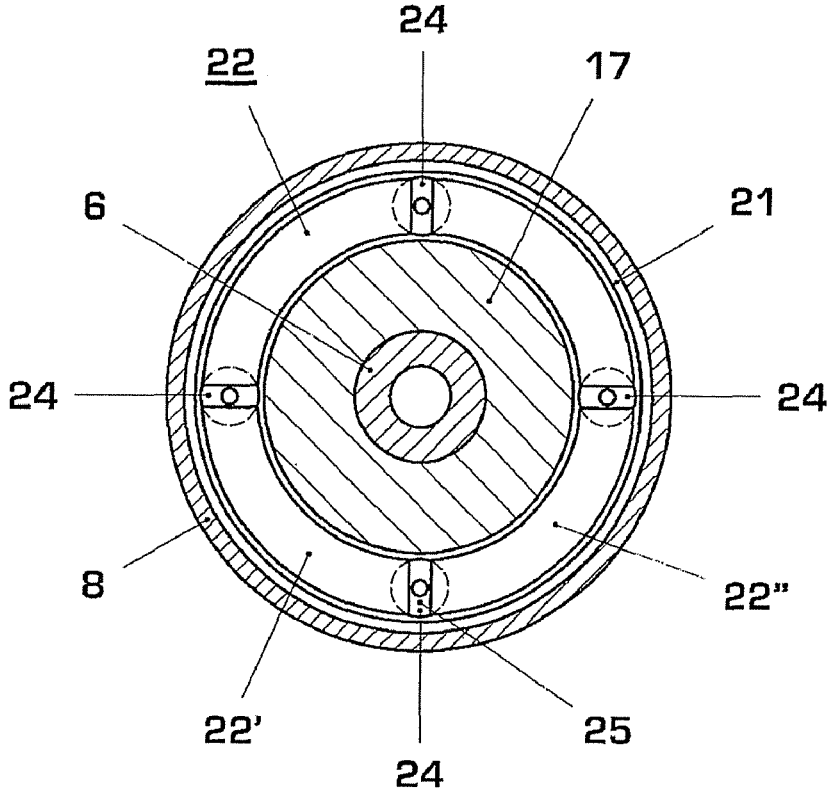
FIG. 3 shows a plan view in the arrow direction of a section guided along III-III through the switching chamber shown in FIG. 2.
Figure 4:
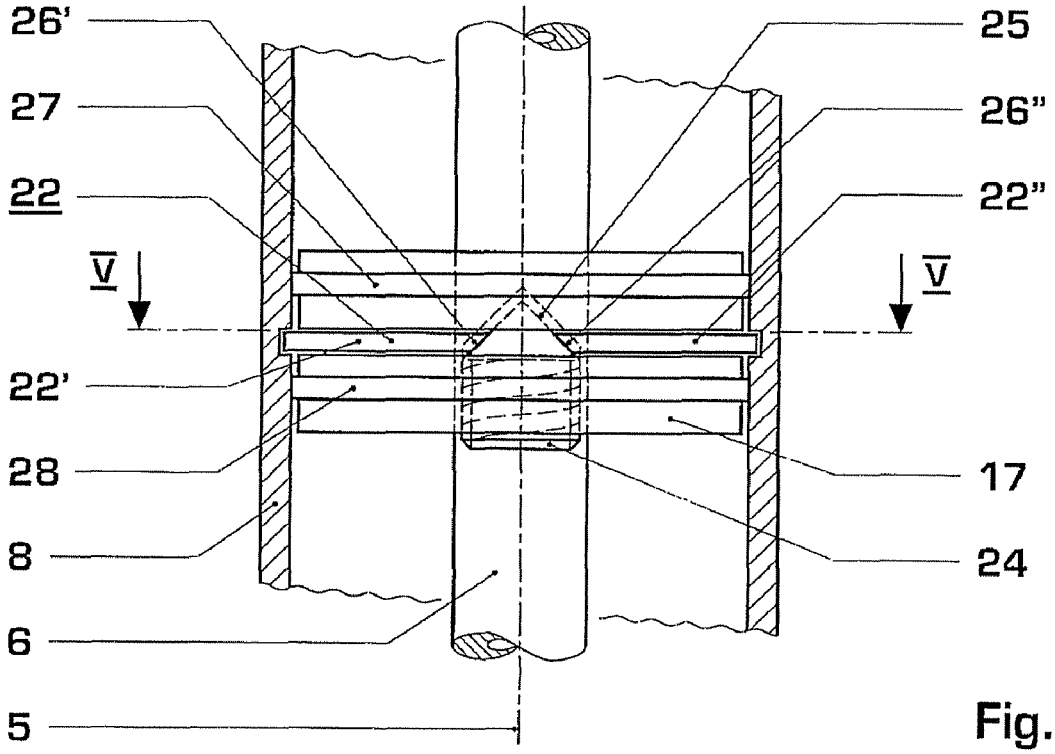
FIG. 4 shows the part of the switching chamber shown in FIG. 2 once the cylinder base has been fixed.
Figure 5:
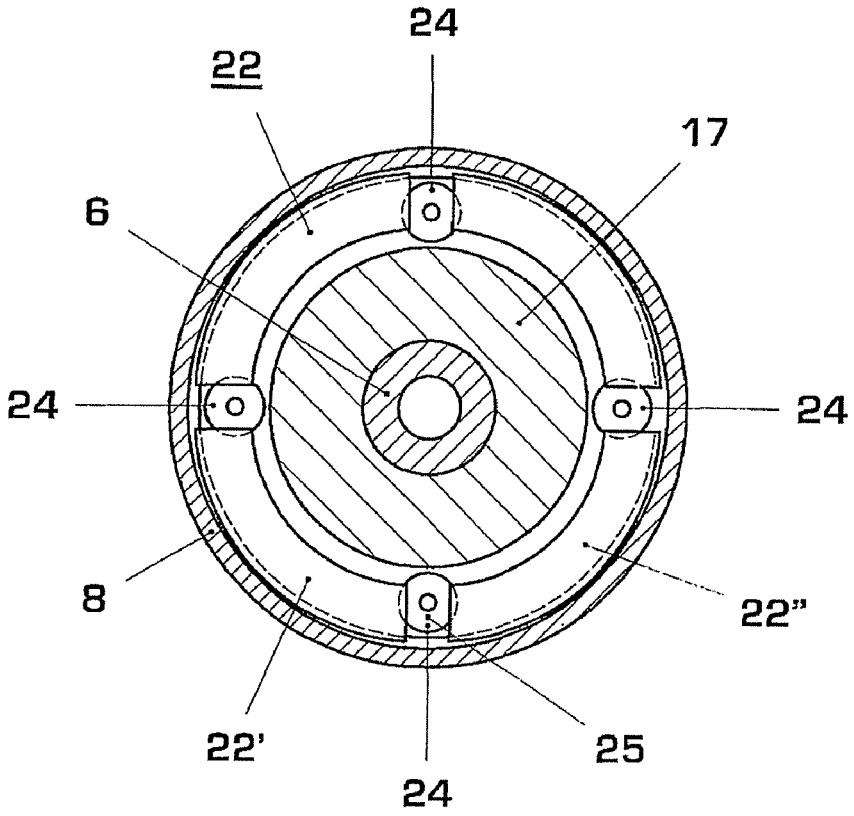
FIG. 5 shows a plan view of a section guided along V-V through the switching chamber shown in FIG. 4.

In both exemplary embodiments, the screw connection has four screws (FIGS. 3 and 5), which are each guided in a nut thread of the cylinder base 17 which is aligned parallel with the axis 5. The screws 24 each contain a free end in the form of a cone 25. The cone 25 is supported on two oppositely inclined faces of two wedges 26', 26". These two wedges are each part of two adjacent circular ring segments 22' and 22", respectively, of the locking element 22, which comprises four identical circular ring segments, as shown (FIGS. 3 and 5). During fitting, the cylinder base 17 is pushed into the tubular conductor 8 (FIGS. 2 and 3). By means of the screws 24 being turned, the wedges 26', 26" and therefore also the associated circular ring segments 22', 22" are spread radially outwards into the depressions 21 and clamped fixedly on the tubular conductor 8 (FIGS. 4 and 5). The cylinder base 17 is then fixed detachably in the tubular conductor 8 and can be removed from the tubular conductor 8 again during maintenance work if required by the screw connection being opened. Elements arranged on the outer casing of the cylinder base 17, such as a seal 27 and a contact ring 28, can then easily be replaced.

The locking element 22 can also have fewer or more than four circular ring segments 22', 22". It is also conceivable for the two wedges 26', 26" to be formed into the two ends of a locking element 22, which is in the form of an open ring, i.e. approximately in the form of a horseshoe, and only a single screw is provided for spreading apart and fixedly clamping this ring. It is of primary importance that, when the screws 24 or the screw is/are tightened, the locking element 22 is guided outwards, is spread into the depression 21 and is fixedly clamped on the tubular conductor 8. The cylinder base 17 is then held by means of the spreading-in in the axial direction with a form-fitting connection and by means of the clamping in the circumferential direction with a force-fitting connection. Instead of an annular depression 21, one or more depressions or wall apertures which extend to a limited extent in the circumferential direction can be formed into the tubular conductor 8. The cylinder base 17 is then also held in the circumferential direction with a form-fitting connection. If the locking element is in the form of a horseshoe, during the spreading-in a prestressing force is formed which resets the spread-in parts of the locking element when the screw connection is detached and thus makes it easier for the cylinder base 17 to be removed.

The projection 23 provided in the exemplary embodiment shown in FIGS. 6 and 7 also fixes the cylinder base 17 during the spreading-in and clamping of the locking element 22 in the axial direction with a form-fitting connection. Since the tubular conductor 8 generally comprises a readily cold-deformable material based on copper or aluminum, this projection can be embossed into the tube 8 using simple means.

In the same way as the cylinder base 17, also the insulating nozzle 12 can be fixed on the tubular conductor 8, the mounting flange 15 on the switching chamber housing 1 and the mounting flange 19 on the tubular conductor 9. This fitting technology provides the following advantages:

- components of different materials can be joined to one another,
- the connection is detachable, with the result that the components can be replaced during maintenance work,
- the connection is matched to the tubular conductor 8 or the switching chamber housing 1 during fitting, with the result that unavoidable fitting inaccuracies can be compensated for,
- a defined mechanical and electrical connection is ensured by the form-fitting and force-fitting connection,
- the fitting complexity is low since the components to be connected can be aligned precisely during manufacture and then fixed easily with the aid of a screw connection, and
- identical connecting elements can be used for fixing different components, such as the cylinder base 17, the insulating nozzle 12 or the mounting flanges 15 and 19.

In the case of electrically and mechanically loaded components comprising a nonmetallic material, such as the insulating nozzle 12 which is preferably made from PTFE, in accordance with the exemplary embodiment shown in FIG. 8 the screw 24 is plugged through an axially aligned through-opening 29 of the insulating nozzle 12. The thread of the screw engages in a nut thread, which is formed into an axially guided compression ring 30 or into a nut 31, which is arranged on the compressing ring (right half of FIG. 8). The locking element 22 is arranged between the insulating nozzle 12 and the compression ring 30 and, when the screw connection is tightened, is guided radially outwards, spreads into the depression 21 (or alternatively behind a projection) and is subsequently fixedly clamped on the tubular conductor 8. The locking element 22 has a radially inwardly directed wedge 26. The wedge is guided on an outwardly inclined bearing face of the compression ring 30. Alternatively, this bearing face can also be arranged on the insulating nozzle 12 (right half of FIG. 8) or the wedge 26 can have two oppositely and inwardly inclined wedge faces.

It can be seen in FIG. 9 that metallic components, such as the mounting flange 15 or the mounting flange 19 or the cylinder base 17, can also be fixed on the switching chamber housing 1 or on the tubular conductor 9 or 8 in a corresponding manner. This figure also shows a locking element 22 with a twice-beveled wedge 26. Corresponding to the exemplary embodiments in FIGS. 2 to 7, the locking element can be in the form of an open circular ring or in the form of a segmented circular ring. FIG. 9 also shows an elastically deformable resetting means 32, which is in the form of an annular spring, which loads the individual circular ring segments of the locking element 22 with a small inwardly directed prestressing force and, in the exemplary embodiment shown in FIG. 9, thus ensures a defined position of the individual segments during fitting.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 switching chamber housing
2 contact arrangement
3,4 switching pieces
5 axis
6, 7 arcing contacts
8, 9 tubular conductors
10, 11 rated current contacts
12 insulating nozzle
13 compression apparatus
14 piston
15 mounting flange
16 cylinder
17 cylinder base
18 deflection gear mechanism
19 mounting flange
20 drive rod
21 depression
22 locking element
22', 22" circular ring segments
23 projection
24 screws
25 cone
26, 26', 26" wedges
27 seal
28 contact ring
29 through-opening
31 compression ring
31 nut
32 resetting means

What is claimed is:

1. A switching chamber for a gas-insulated high-voltage switch with a housing filled with insulating gas and a contact arrangement held in the housing, containing, in a coaxial arrangement, two switching pieces, which are capable of being displaced relative to one another along an axis, with in each case one arcing contact and in each case one tubular conductor, which is electrically conductively connected to the arcing contact and into which a rated current contact, which surrounds the arcing contact, is formed, an insulating nozzle, which surrounds the two arcing contacts, and a compression apparatus with a fixed piston and a cylinder, in which a moveable first of the two tubular conductors forms the wall of the cylinder, is electrically conductively and rigidly connected to a first of the two arcing contacts via a base of the cylinder and bears the insulating nozzle, wherein a screw connection is arranged in the peripheral region of the insulating nozzle, of the cylinder base, of a first mounting flange for fixing the piston on the switching chamber housing or of a second mounting flange for fixing a deflection gear mechanism, which is connected to the second arcing contact, which screw connection has a radially displaceable locking element, which fixes the insulating nozzle, the cylinder base, the first or the second mounting flange by spreading into and being clamped in one of the two tubular conductors or in the switching chamber housing.

2. The switching chamber as claimed in claim 1, wherein a projection is formed into the switching chamber housing, the first or the second tubular conductor, and the locking element engages behind said projection.

3. The switching chamber as claimed in claim 1, wherein a depression is formed into the switching chamber housing, the first or the second tubular conductor, and the locking element is spread into said depression.

4. The switching chamber as claimed in claim 1, wherein a screw of the screw connection is guided in an axially aligned nut thread, which is arranged in the insulating nozzle, the cylinder base, the first or the second mounting flange, and has a free end in the form of a cone, which free end is supported on oppositely inclined faces of two wedges, which are either formed into the two ends of a locking element in the form of an open circular ring or the first of these two wedges is formed into a first circular ring segment and the second is formed into a second circular ring segment, in each case of a locking element in the form of a segmented circular ring.

5. The switching chamber as claimed in claim 1, wherein a screw of the screw connection is plugged through an axially aligned through-opening of the insulating nozzle, of the cylinder base, of the first or of the second mounting flange and engages in a nut thread, which is formed into an axially guided compression ring or into a nut arranged on the compression ring, and wherein the locking element is arranged between the insulating nozzle, the cylinder base, the first or the second mounting flange and the compression ring and is guided radially outwards by means of the wedge effect.

6. The switching chamber as claimed in claim 5, wherein a wedge is formed into the locking element, which wedge is guided on an outwardly inclined bearing face of the insulating nozzle, of the cylinder base, of the first or of the second mounting flange or of the compression ring.

7. The switching chamber as claimed in claim 6, wherein the wedge has two oppositely and inwardly inclined wedge faces, of which the first wedge face is guided on an outwardly inclined bearing face of the insulating nozzle, of the cylinder base, of the first or of the second mounting flange and the second is guided on an outwardly inclined face of the compression ring.

8. The switching chamber as claimed in claim 5, wherein the locking element is in the form of an open circular ring or in the form of a segmented circular ring.

9. The switching chamber as claimed in claim 4, wherein the screw connection has at least two screws, which are arranged so as to be offset in the circumferential direction and are guided axially.

10. The switching chamber as claimed in claim 1, wherein the locking element interacts with an elastically deformable resetting means.

11. The switching chamber as claimed in claim 3, wherein a screw of the screw connection is guided in an axially aligned nut thread, which is arranged in the insulating nozzle, the cylinder base, the first or the second mounting flange, and has a free end in the form of a cone, which free end is supported on oppositely inclined faces of two wedges, which are either formed into the two ends of a locking element in the form of an open circular ring or the first of these two wedges is formed into a first circular ring segment and the second is formed into a second circular ring segment, in each case of a locking element in the form of a segmented circular ring.

12. The switching chamber as claimed in claim 3, wherein a screw of the screw connection is plugged through an axially aligned through-opening of the insulating nozzle, of the cylinder base, of the first or of the second mounting flange and engages in a nut thread, which is formed into an axially guided compression ring or into a nut arranged on the compression ring, and wherein the locking element is arranged between the insulating nozzle, the cylinder base, the first or the second mounting flange and the compression ring and is guided radially outwards by means of the wedge effect.

13. The switching chamber as claimed in claim 7, wherein the locking element is in the form of an open circular ring or in the form of a segmented circular ring.

14. The switching chamber as claimed in claim 8, wherein the screw connection has at least two screws, which are arranged so as to be offset in the circumferential direction and are guided axially.

15. The switching chamber as claimed in claim 9, wherein the locking element interacts with an elastically deformable resetting means.

16. A contact arrangement held in a housing of a switching chamber for a gas-insulated high-voltage switch, comprising, in a coaxial arrangement:

two switching pieces, which are capable of being displaced relative to one another along an axis, with in each case one arcing contact and in each case one tubular conductor, which is electrically conductively connected to the arcing contact and into which a rated current contact, which surrounds the arcing contact, is formed;

an insulating nozzle, which surrounds the two arcing contacts; and a compression apparatus with a fixed piston and a cylinder, in which a moveable first of the two tubular conductors forms the wall of the cylinder, is electrically conductively and rigidly connected to a first of the two arcing contacts via a base of the cylinder and bears the insulating nozzle, wherein a screw connection is arranged in the peripheral region of the insulating nozzle, of the cylinder base, of a first mounting flange for fixing the piston on the switching chamber housing or of a second mounting flange for fixing a deflection gear mechanism, which is connected to the second arcing contact, which screw connection has a radially displaceable locking element, which fixes the insulating nozzle, the cylinder base, the first or the second mounting flange by spreading into and being clamped in one of the two tubular conductors or in the switching chamber housing.

* * * * *